United States Patent [19]

Racciato

[11] 4,311,601

[45] Jan. 19, 1982

[54] USE OF HETEROPOLYSACCHARIDE S-119 AS A WARP SIZE

[75] Inventor: Joseph S. Racciato, San Diego, Calif.

[73] Assignee: Merck & Co., Inc., Rahway, N.J.

[21] Appl. No.: 177,691

[22] Filed: Aug. 13, 1980

[51] Int. Cl.[3] ..... D06M 15/04

[52] U.S. Cl. ..... 252/8.6

[58] Field of Search ..... 8/561; 252/8.6; 427/394

[56] References Cited

U.S. PATENT DOCUMENTS 3,928,676 12/1975 Drelich et al. ..... 428/262
3,933,788 1/1976 Kang et al. ..... 8/561
4,186,025 1/1980 Kang et al. ..... 8/561

OTHER PUBLICATIONS

Hisamatsu et al., Carbohydrate Research, 61 (1978), pp. 89–96.

Zevenhuizen, Carbohydrate Research, 26 (1973), pp. 409–419.

*Primary Examiner*—Maria Parrish Tungol

*Attorney, Agent, or Firm*—Gabriel Lopez; Hesna J. Pfeiffer

[57] ABSTRACT

S-119 is used as a warp size for textiles, either alone or as an additive with other sizes such as starch, polyvinyl alcohol, CMC, etc.

10 Claims, No Drawings

USE OF HETEROPOLYSACCHARIDE S-119 AS A WARP SIZE

CROSS-REFERENCE

The preparation of S-119 is disclosed and claimed in U.S. Pat. No. 4,269,939.

BACKGROUND OF THE INVENTION

In weaving textiles, the threads put on the loom in the linear direction are known as the warp. Because of the rubbing and abrasion during the weaving operation, the thread used for warp must be sized to tie down loose ends which might become entangled, to provide resiliency, to provide some added strength, and to lubricate the warp. Size is typically applied during the warping operation by the slasher, a multi-function apparatus that coats the warp threads, squeezes them through rollers to remove excess size, and dries them before they go into the loom. Since many warp sizes, such as starch, congeal at room temperature, usually the size is applied hot. Size is applied to a wide variety of fibers, both natural and man-made. Warp size is used on cotton, polyester, nylon, rayon, various spun yarns and continuous filament threads. The amount of size used would depend on the make-up of the size and on the fibers being treated. Thus, a natural spun yarn such as cotton requires large amounts of natural size such as starch (up to 15% and more add-on), whereas continuous filament thread, where the size acts primarily as a lubricant, is treated with a synthetic size such as polyvinyl alcohol at only a 1½ to 3% add-on level. "Add-on" is the amount of size (% dry basis) put on a fabric based on the weight of the fabric.

One property of a size which is critical is its ability to be easily removed; i.e., after weaving the fabric must be washed to remove the size so that it will not interfere with any subsequent fabric treatment such as printing. Starch is typically removed by enzyme treatment; polyvinyl alcohol (PVOH) by hot scours.

SUMMARY OF THE INVENTION

It has now been found that heteropolysaccharide S-119 and similar heteropolysaccharides such as those produced by *A. tumefaciens* A-8 and A-10 and others from other *A. radiobacter* strains are useful as a warp size either alone or in combination with known sizes.

DETAILED DESCRIPTION OF THE INVENTION

The invention is the use of S-119 and similar heteropolysaccharides as a warp sizing agent for textiles, either alone or as an additive with other common sizing agents such as starch, PVOH, CMC, etc. When it is to be combined with other sizes, S-119 can be blended on a wt:wt basis in the range of ratios (S-119:sizing agent) of 90:10 to 2:98. Alone, S-119 forms smooth films of high tensile strength. With starch, S-119 improves the filming properties and tensile strength; with PVOH, S-119 improves the washout characteristics of the size. In order to improve the properties of sizing agents, it has often been necessary to compromise some other property, e.g., lose elongation to improve washout. Surprisingly, S-119 can be used to improve washout without damaging elongation or tensile strength of, for example, PVOH at the typical relative humidity found in weave rooms (usually 60% or greater).

In addition to the use of S-119 with other sizes, S-119 can also be combined with sizing additives such as the plasticizer glycerin (1,2,3-propanetriol).

S-119 sizes are prepared by adding S-119 to water over a broad range of temperatures (typically room temperature up to about 50° C.) at a concentration conveniently ranging from about 4%–9% although 2% to 15% solutions can also be prepared. The mixture is agitated by any convenient means until the solution is lump-free and smooth. A plasticizer can be conveniently added during this procedure as can other sizes when a blend is preferred. The S-119 sizes are applied to the threads used as a warp in the following representative amounts (given as % add-on weight):

| | |
|---|---|
| Cotton | 4–12% |
| Polyester | 5–10% |
| Rayon | 4–12% |
| Nylon | 4–10% |

Other materials suitable for sizing include: acrylic, polypropylene, fiberglass, modacrylic, and acetate. The size is ready for application when it is lump-free and smooth. Application temperatures range from ambient to about 71° C. The size is applied at a pick-up of 50–150.

When used as the sole sizing agent, S-119 is used in a 2 to 15% (wt/wt) aqueous solution (preferably 4 to 9% (wt/wt).

The following blends of S-119 with known sizes are also recommended.

| | |
|---|---|
| S-119:PVOH | 40:60 to 2:98 |
| S-119:starch | 50:50 to 5:95 |

A typical S-119 blend would be prepared by adding 0.35 kg S-119 and 6.65 kg Evanol ® T-25 (PVOH) to 93 kg of water at ambient temperature with agitation. This mixture is heated to 70° C. with continuous agitation. After mixing until the PVOH is dissolved, the size is ready for use.

When a plasticizer such as glycerin is added, it can be used either with S-119 alone or with S-119 blends. Glycerin can be added at 2 to 25% (based on weight of sizing agents) although 10% is more typical.

DESCRIPTION OF S-119 AND SIMILAR POLYSACCHARIDES

Organisms classified as *Agrobacterium radiobacter* IFO (Institute of Fermentation, Osaka) 12607, IFO 12664, IFO 12665, IFO 13127, IFO 13256, IFO 13532 and IFO 13533 have been used to produce exocellular polysaccharides (Hisamatsu, et al., "Acidic Polysaccharides Containing Succinic Acid in Various Strains of Agrobacterium", Carbohydrate Research, 61 (1978) 89–96). These organisms were grown in a synthetic medium described in Amemura, et al., Hakko Kogaku Zasshi; 49 (1971) 559–564, Chem. Abst. 75, 1971, 74882j.

An exopolysaccharide containing D-glucose, D-galactose, pyruvic acid, and O-acetyl groups in the approximate proportions 6:1:1:1.5 is described by L. P. T. M. Zevenhuizen, "Methylation Analysis of Acidic Exopolysaccharides of Rhizobium and Agrobacterium", Carbohydrate Research, 26 (1973) 409–419. The organisms used by Zevenhuizen are described as *A. tumefaciens* A-8 and A-10.

A variant strain of *A. radiobacter,* ATCC 31643, produces a water-soluble heteropolysaccharide of composition similar to that described for *A. tumefaciens* A-8 and A-10 when incubated in a selected nutrient medium. An unrestricted deposit of this hitherto undescribed organism was made with the American Type Culture Collection on May 12, 1980 under Accession No. ATCC 31643.

The organism was isolated from a soil sample obtained in Kahuka, Hawaii. The organism was picked as a gummy colony after five days' incubation at 30° C. from an E-1 agar plate with 1% 42DE corn syrup as the carbon source. The isolate was then pure cultured on nutrient agar.

A YM flask seed was started with a fresh NA plate and placed on a gyrotary shaker at 30° C. Approximately 24 hrs. later this seed was used to inoculate an E-1 flask with 3% hydrolyzed starch as the carbon source. This flask was also placed on a shaker at 30° C. Approximately 72 hrs. later the flask was noted to have viscous beer and upon addition of two volumes of 99% IPA a fibrous precipitate was observed.

Another YM seed flask was prepared in the above fashion and used at 24 hrs. to inoculate five flasks containing various media. These flasks were incubated on a shaker at 30° C. for about 72 hrs. at which the pH, viscosity, gum yield, and product viscosity were measured. The results are shown in Table 1.

TABLE 1

EFFECT OF MEDIA ON GUM PRODUCTION

| Medium | pH | Beer Vis. (cP) | Gum Yield(%) | 1% Product Vis.(cP) |
|---|---|---|---|---|
| E-1 | 7.4 | 120 | 0.650 | ND |
| E-1 − $NH_4NO_3$ + 0.19% $KNO_3$ | 8.2 | 160 | 0.310 | ND |
| E-1 + 0.15% Promosoy _ | 7.2 | 1000 | 1.278 | ND |
| E-1 + HoLe salts | 6.9 | 1800 | 1.524 | 800 |

ND: Not determined

E-1 medium contains 5 gms of dipotassium phosphate, 0.1 gm of magnesium sulfate, 0.9 gm of ammonium nitrate, 0.5 gm of Promosoy 100 (an enzymatic digest of soybean meal sold by Central Soya Chemurgy Division), 30 gms of dextrose and 1 liter of tap water. The pH of the E-1 medium is about 7.6 to 7.8.

The organism has been scaled-up in 14 L and 70 L fermentors. The data on these scale-ups is given in Table 2. Viscosities are measured on a Brookfield LVF viscometer at 60 rpm, room temperature, with spindles 2 (<500 cP), 3 (500–2000 cP), or 4 (>2000 cP).

TABLE 2

| Medium | Age (hrs) | Beer Vis.(cP) | RCS (%)* | Gum Yield (%) | 1% Product Vis. (cP) |
|---|---|---|---|---|---|
| E-1 + HoLe salts | 0 | — | 3.07 | — | — |
| + 1 ppm Fe++ | 63 | 1430 | 0.1 | 2.03 | 450 |
| Same as above | 0 | — | 2.55 | — | — |
| | 42 | 1330 | 0.1 | 1.60 | 370 |
| Same as above | 0 | — | 3.05 | — | — |
| | 38 | 1270 | 0.1 | 1.84 | 355 |
| Same as above + | 0 | — | ND | — | — |
| 0.03% Promosoy 100 + 0.01% $MgSO_4$. | 38 | 1490 | 0.86 | 1.86 | — |
| $7H_2O$ + 0.06% $NH_4NO_3$. Total of 5% glucose added | 77 | 2350 | 0.1 | 2.41 | 440 |

TABLE 2-continued

| Medium | Age (hrs) | Beer Vis.(cP) | RCS (%)* | Gum Yield (%) | 1% Product Vis. (cP) |
|---|---|---|---|---|---|
| as carbon source | | | | | |

*Residual carbon source; fermentation is "complete" when RCS ≦ 0.1%.

The following is a summary of the taxonomic study of ATCC 31643, hereinafter also referred to as S-119.

A. Characteristics of Colonial Morphology

On nutrient agar, small translucent non-pigmented colonies (0.2–0.3 mm in diameter) appear in 2 days at ambient temperature; diameter reaches 1.2–1.5 mm after 5 days' incubation. The colonies are round, entire, and convex. Slimy properties are not observed.

On YM agar, small opaque, mucoid, white-to-gray colonies (0.2–0.3 mm in diameter) appear in 2 days at ambient temperature; diameter reaches 2.2–2.5 mm after 5 days' incubation. The colonies are round, entire, and convex, but a thick wrinkled formation appears after prolonged incubation. No hard membraneous texture is observed, although it is slimy.

B. Characteristics of Cell Morphology

The strain S-119 is a gram-negative, rod-shaped bacterium. On nutrient agar the average size of the cell is 0.5 by 0.8–1.2 μm, round at both ends. Vacuole-like structures are often observed. Bipolar stain may be common.

On YM agar the cells are larger; average size is about 0.6 by 2.0–2.5 μm, round at both ends. One end is larger than the other. Vacuoles often appear and this causes uneven staining of the cell. Some cells tend to have a curvature, and pallisade arrangement of cells is common. Y-shaped cells are occasionally observed. Motility is by means of the mixed flagellation, polar monotrichously, and peritrichously flagellation.

C. Physiological and Biochemical Characteristics

Cytochrome oxidase, catalase positive; aerobic. Organism is capable of growth at 41° C. but not at 43° C. Survival at 60° C. for 30 minutes. Tolerance to 3.0% but not to 6.5% NaCl. Growth at pH's between 5 and 12.

Many carbohydrates were utilized. Acid but not gas was produced from the following carbohydrates.

| | | | |
|---|---|---|---|
| D-Xylose | Galactose | Melibose | Adonitol |
| L-Arabinose | Mannose | Sucrose | Sorbitol |
| D-Glucose | Lactose | Trehalose | Inositol |
| Fructose | Maltose | Raffinose | |

Acid was *not* produced from the following carbohydrates.

| | |
|---|---|
| L-Rhamnose | Salicin |
| Dulcitol | Inulin |

Neutral or weak alkali reaction observed. No serum zone formed. $H_2S$ produced from cystein. ADH, LDC and ODC were negative. Indole, VP, MR, and Simmon's citrate tests were negative. Gelatin, casein, starch, Tween 80, esculin, and egg yolk were not hydrolyzed. The 3-Ketolactose test was negative.

Organisms grown on EMB, MacConkey, and SS agar but not on Mannitol salt or Tellurite Blood agar. Congo Red dye was absorbed. Tolerance to 0.02 and 0.1% tiphenyltetrazolium chloride.

D. Antibiotic Susceptibility Test

The strain S-119 is susceptible to the following antibiotics.

| | | | |
|---|---|---|---|
| Kanamycin | 30 μg | Erythromycin | 15 μg |
| Neomycin | 30 μg | Tetracycline | 30 μg |
| Chlortetracycline | 5 μg | Gentamicin | 10 μg |
| Novobiocin | 30 μg | Carbenicillin | 50 μg |

The strain S-119 is *not* susceptible to the following antibiotics.

| | | | |
|---|---|---|---|
| Penicillin | 10 units | Colistin | 10 μg |
| Streptomycin | 10 μg | Polymyxin B | 300 units |

E. Nutritional Characteristics

Growth factors are not required for growth. Ammonium salts serve as sole nitrogen source. At least 53 out of the 114 organic compounds tested are utilized as a sole source of carbon and energy. They are as follows:

| | | |
|---|---|---|
| D-Ribose | Acetate | L-α-Alanine |
| D-Xylose | Propionate | D-α-Alanine |
| D-Arabinose | Succinate | β-Alanine |
| L-Arabinose | Fumarate | L-Serine |
| D-Fucose | D-Malate | L-Threonine |
| L-Rhamnose | DL-Lactate | L-Leucine |
| D-Glucose | DL-Glycerate | DL-Norleucine |
| D-Mannose | Citrate | L-Aspartate |
| D-Galactose | Pyruvate | L-Glutarate |
| D-Fructose | Mannitol | DL-Arginine |
| Succorse | Sorbol | DL-Ornithine |
| Trehalose | Adonitol | α-Aminobutyrate |
| Maltose | Glycerol | L-Histidine |
| Cellobiose | Ethanol | L-Proline |
| Lactose | N-Propanol | L-Tyrosine |
| Gluconate | p-Hydroxybenzoate | Betaine |
| 2-Ketogluconate | Quinate | Sarcosine |
| Salicin | Glycine | |

F. Biochemical and Other Miscellaneous Tests

See Table 3.

G. Identification

The strain S-119 is a gram-negative, aerobic, rod-shaped organism. Motile by mixed (i.e., polar and peritrichous) flagella. Oxidase and catalase are positive. Many carbohydrates are utilized. Cells are often pear-shaped; vacuolated forms are pallisade arrangement of cells are common. Y-shaped forms and accumulation of poly-β-hydroxybutyrate may be observed. Citrate is utilized. According to the Bergey's Manual (8th edition) the organism is a member of the genus Agrobacterium. The similarity value ($S_J$) of the organism compared with a reference strain *Agrobacterium radiobacter* (ATCC 19358) showed 76.9%, which is within the species level according to Colwell and Liston (1961). This organism does not produce 3-ketolactose. Therefore this organism is a variant strain of *Agrobacterium radiobacter.*

TABLE 3

Biochemical and Other Miscellaneous Tests Employed for the Strain S-119

| | | | |
|---|---|---|---|
| Oxidase - Kovac's | + | Hydrolysis of: | |
| Pathotech | + | Gelatin | – |
| Catalase | + | Casein | – |
| OF medium: oxidative | + | Starch | – |
| fermentative | – | Tween 80 | – |
| Gas from glucose | – | Pectin | – |
| $H_2S$ production: T&I | – | Alginate | – |
| Cystine | + | Cellulose | – |
| Ammonium from peptone | NT | Chitin | – |
| β-Galactosidase | ± | DNA | NT |
| Arginine dihydrolase | – | Esculin | – |
| Lysine decarboxylase | – | Growth on various media: | |
| Ornithine decarboxylase | – | EMB agar | + |
| Tryptophan deaminase | NT | MacConkey agar | + |
| Phenylalanine deaminase | NT | SS agar | + |
| Urease | – | Mannitol salt agar | – |
| Indole | – | TCBS agar | – |
| MR test | – | Tinsdale tellurite | |
| VP test | – | blood agar | – |
| Nitrate reduction | – | Pseudosel agar | – |
| Nitrate reduction | – | Pigment production: | |
| Denitritication | NT | King A medium | – |
| N-fixation: | | King B medium | – |
| Growth on Burk's medium | – | Dye Reaction: | |
| Nitrogenase activity | NT | Congo Red | + |
| Malonate (oxidation) | – | Nile Blue | NT |
| Phosphatase | – | | |
| Haemolysis | – | | |
| Litmus milk: | | | |
| Change in color | None | | |
| peptonization | None | | |
| reduction | None | | |
| 3-Ketolactose | – | | |
| Survival at 60° C. for 30 min. | + | | |
| T & I: Slant | No change | | |
| Butt | No growth | | |
| Gas | – | | |
| Egg Yolk Reaction | – | | |

NT = Not Tested

FERMENTATION CONDITIONS

Heteropolysaccharide S-119 is produced during the aerobic fermentation of suitable aqueous nutrient media under controlled conditions via the inoculation with the organism ATCC 31643. The media are usual media, containing source of carbon, nitrogen and inorganic salts.

In general, carbohydrates (for example, glucose, fructose, maltose, sucrose, xylose, mannitol and the like) can be used either alone or in combination as sources of assimilable carbon in the nutrient medium. The exact quantity of the carbohydrate source or sources utilized in the medium depend in part upon the other ingredients of the medium but, in general, the amount of carbohydrate usually varies between about 2% and 5% by weight of the medium. These carbon sources can be used individually, or several such carbon sources may be combined in the medium. In general, many proteinaceous materials may be used as nitrogen sources in the fermentation process. Suitable nitrogen sources include, for example, yeast hydrosylates, primary yeast, soybean meal, cottonseed flour, hydrolysates of casein, corn-steep liquor, distiller's solubles or tomato paste and the like. The sources of nitrogen, either alone or in combination, are used in amounts preferably ranging from about 0.05% to 0.2% by weight of the aqueous medium. Promosoy 100 has been used in the range 0.005 to 0.4%.

Among the nutrient inorganic salts which can be incorporated in the culture media are the customary salts capable of yielding sodium, potassium, ammonium, calcium, phosphate, sulfate, chloride, carbonate, and like ions. Also included are trace metals such as cobalt, manganese, iron and magnesium.

It should be noted that the media described in the examples are merely illustrative of the wide variety of media which may be employed, and are not intended to be limiting.

As an alternate medium, S-119 may be grown under low $Ca^{++}$ conditions, i.e., in deionized water or some other aqueous system substantially free of $Ca^{++}$ ions (i.e., less than about 4 ppm $Ca^{++}$ per 1% gum in the final fermentor broth).

The fermentation is carried out at temperatures ranging from about 25° C. to 35° C.; however, for optimum results it is preferable to conduct the fermentation at temperatures of from about 28° C. to 32° C. The pH of the nutrient media for growing the ATCC 31643 culture and producing the polysaccharide S-119 can vary from about 6 to 8.

Although the polysaccharide S-119 is produced by both surface and submerged culture, it is preferred to carry out the fermentation in the submerged state.

A small scale fermentation is conveniently carried out by inoculating a suitable nutrient medium with the culture and, after transfer to a production medium, permitting the fermentation to proceed at a constant temperature of about 30° C. on a shaker for several days.

The fermentation is initiated in a sterilized flask of medium via one or more stages of seed development. The nutrient medium for the seed stage may be any suitable combination of carbon and nitrogen sources. The seed flask is shaken in a constant temperature chamber at about 30° C. for 1–2 days, or until growth is satisfactory, and some of the resulting growth is used to inoculate either a second stage seed or the production medium. Intermediate stage seed flasks, when used, are developed in essentially the same manner; that is, part of the contents of the flask from the last seed stage are used to inoculate the production medium. The inoculated flasks are shaken at a constant temperature for several days, and at the end of the incubation period the contents of the flasks are recovered by precipitation with a suitable alcohol such as isopropanol, conveniently in the form of CBM (an 85:15 alcohol:water constant boiling mixture).

For large scale work, it is preferable to conduct the fermentation in suitable tanks provided with an agitator and a means of aerating the fermentation medium. According to this method, the nutrient medium is made up in the tank and sterilized by heating at temperatures of up to about 121° C. Upon cooling, the sterilized medium is inoculated with a previously grown seed of the producing culture, and the fermentation is permitted to proceed for a period of time as, for example, from 2 to 4 days while agitating and/or aerating the nutrient medium and maintaining the temperature at about 30° C. This method of producing the S-119 is particularly suited for the preparation of large quantities.

Although ATCC 31643 can be grown under a broad spectrum of media conditions, the following preferred conditions are recommended.

1. Culture Maintenance

The culture grows quite well on nutrient agar (NA) or YM agar, but NA is preferred for culture maintenance.

2. Seed Preparation

Seed preparation for this organism is started in YM broth and incubated at 30° C. The YM seeds are then used at 24–30 hrs to inoculate seed medium. The composition of the seed medium is as follows:

| | |
|---|---|
| 3.0% | Glucose |
| 0.5% | $K_2HPO_4$ |
| 0.05% | Promosoy 100 |
| 0.09% | $NH_4NO_3$ |
| 0.01% | $MgSO_4 \cdot 7H_2O$ |
| 1 ppm | $Fe^{++}$ |
| 1 ppm | $Mn^{++}$ |

A 5 to 10% inoculum size is used at 24–30 hrs to inoculate the final fermentor.

3. 70L Fermentor Medium

| | |
|---|---|
| 5.0% | Glucose |
| 0.05% | $K_2HPO_4$ |
| 0.20% | Promosoy 100 |
| 0.15% | $NH_4NO_3$ |
| 0.05% | $MgSO_4 \cdot 7H_2O$ |
| 1 ppm | $Fe^{++}$ |
| 1 ppm | $Mn^{++}$ |

The pH should be controlled at 6.5–7.2; the temperature at 30° C.

Fermentation times range from 60–70 hrs with beer viscosity ranging from 1900 cP to 2300 cP. Conversion efficiencies vary from 48–52% with 5% glucose. Antifoam SAG 471 (Union Carbide) is used.

Gram stains made from S-119 fermentation beer show gram-negative club-shaped cells approximately $0.6 \times 2.02.5\mu$ in size.

4. Recovery

On completion of the fermentation, the heteropolysaccharide S-119 may be recovered by treatment of the fermentation beer with a miscible solvent which is a poor solvent for the heteropolysaccharide and does not react with it. In this way the heteropolysaccharide is precipitated from solution. The quantity of solvent employed generally ranges from about 2 to about 3 volumes per volume of fermentation beer. Among the various solvents which may be employed are acetone and lower alkanols such as methanol, ethanol, isopropanol, n-butanol, sec-butanol, tertiary butanol, isobutanol, and n-amyl alcohol. Isopropanol is preferred. Precipitation of S-119 is facilitated when the fermentation beer is first heated to a temperature of about 70° to 75° C. for a short time, e.g., about 5 to 10 minutes, and then cooled to about 30° C. or lower before addition of the solvent. A spent alcohol concentration of 57–59% is required for precipitation. Thus, this is a preferred method of precipitating the heteropolysaccharide from the fermentation beer. The solid is recovered by separating it from the liquid, as by filtering or straining, and then drying at elevated temperature.

5. Drying

The product is dried at 55° C. for up to one hour in a forced-air tray drier.

6. Product Quality

One percent deionized water viscosities range from 250–450 cP as a measured on a Brookfield LVF, spindle 2, 60 rpm at 25° C.

HETEROPOLYSACCHARIDE S-119

The heteropolysaccharide produced by ATCC 31643 is composed of principally carbohydrate, 2.9–3.5% (calculated as O-acetyl) O-acyl groups as the O-glycosidically linked esters, which are acetyl or succinyl or a combination thereof, 3.0–4.0% pyruvate, and about 12% protein. It has a negative optical rotation, indicating principally $\beta$-linkages ($[\alpha]_{589}=-14°$; $[\alpha]_{578}=-15°$). These values were obtained from 1% solutions in D.I. water.

The carbohydrate portion of the S-119 polysaccharide contains uronic acid and the neutral sugars glucose (88%) and galactose (12%). The approximate molar ratio of glucose to galactose is 7.4:1. Colloidal titration (DIMDAC/sulphonic acid method) indicates the gum is anionic (0.9 m. equivalents of anionic groups/g. gum).

The acetyl content of 3.5% was determined by treating a 0.2% aqueous solution of S-119 gum with an alkaline, hydroxylamine reagent followed by treatment with an acidic ferric chloride reagent [S. Hestrin (1949) *J. Biol. Chem.* 180 249–261].

The neutral sugars of polysaccharide S-119 were determined by dissolving ten mg. of the product in 2 ml 2 N $H_2SO_4$, and the mixture is heated at 100° C. for 4 hours. The resulting solution is cooled, neutralized with barium hydroxide and the pH is brought to 5–6 with solid carbon dioxide. The resulting precipitate of barium sulfate is removed by centrifugation and the supernatent is concentrated to a syrup under reduced pressure. The sugars in the hydrolysate are tentatively identified by gas-liquid chromatography of their aldononitrile acetone derivatives on a Hewlett-Packard Model 5750 chromatograph using 3% by weight OV-225 on 80/100 mesh Gas Chrom Q at 210° C. The sugars are identified and quantitated by comparison with authentic standards [J. K. Baird, M. J. Holroyde, and D. C. Ellwood (1973) Carbohydr. Res. 27 464–467].

The various neutral sugars of the polysaccharides were also characterized by use of descending paper chromagraphy on Whatman No. 1 chromatography paper using as the solvent the upper layer of pyridine:ethyl acetate:water (2:5:5). Chromatograms were stained using silver nitrate dip and acid aniline phthalate spray reagent. Component sugars were identified by co-chromatography with sugar standards and by the specific-color reaction with the aniline phthalate reagent.

The uronic acid content of the polysaccharide was determined by two separate methods. In one method the sample was decarboxylated with 19% hydrochloric acid and the liberated carbon dioxide was trapped in standard sodium hydroxide and determined by back titration [B. L. Browning (1967) *Methods of Wood Chemistry II,* 632–633] and by the carbazole colorimetric method [T. Bitter and H. M. Muir (1962) *Anal. Biochem.* 4 330–334]. The decarboxylation method gave the value 2.8%; colorimetric gave 4.8%.

Paper electrophoresis was used for the separation and tentative identification of the uronic acids present in the neutralized acid hydrolysate described above. Aliquots of this and known uronic acid standards were applied to Camag electrophoresis paper No. 68-011 and electrophoresis was carried out for 2.0 hours in a pH 2.7 buffer using a Camag Model HVE electrophoresis apparatus. Chromatograms were air dried and stained with silver nitrate dip reagent to locate the uronic acids being separated. No uronic acid spots were found by this method.

An infrared spectrum of native S-119 was made on dried material in a KBr pellet. The heteropolysaccharide evidenced peaks at: 1725 $cm^{-1}$, 1600–1650 $cm^{-1}$, and 1350–1400 $cm^{-1}$.

Heteropolysaccharide S-119 has the following profile of properties (all measurements are at room temperature):

1. VISCOSITY (Brookfield LVT Viscometer)

| Conc. | Spindle | RPM | Viscosity (cP) D.I. $H_2O$ | Viscosity (cP) D.I. + 0.1% KCl |
|---|---|---|---|---|
| 1.0% | 3 | 60 | 920 | 1050 |
| — | 3 | 6 | 6900 | — |
| 0.1% | 1 + UL adap. | 6 | 35 | 30 |
| 0.5% | (Wells-Brookfield @ 9.6 $sec^{-1}$) | — | 440 | 490 |

2. SHEAR (Wells-Brookfield Microviscometer RVT - c/P)

1. n @ 1.92 $sec^{-1}$ 5120 cP
2. n @ 9.6 $sec^{-1}$ 1270 cP
3. n @ 76.8 $sec^{-1}$ 210 cP
4. n @ 384 $sec^{-1}$ 30 cP
5. n @ 384 $sec^{-1}$ 40 cP
6. n @ 9.6 $sec^{-1}$ 1240 cP 3. 50° C. STORAGE STABILITY (4 weeks)

Day 1: 447.5 cP, Brookfield LVT, spin. #2, 60 rpm
Wk. 4: 540 cP, Brookfield LVT, spin. #3, 60 rpm

4. ACID, BASE, HEAT, STABILITY

| A. Stability | Initial n | Final n | % Change |
|---|---|---|---|
| 1. Acetic acid plus heat | 1170 cP | 970 cP | −17 |
| 2. 1% HCl plus heat | 1330 cP | Total loss | Total loss |
| 3. 1% NaOH plus heat | 970 cP | 270 cP | −72 |
| 4. Heat only | 1230 cP | 500 cP | −59 |

B. pH Effect (Wells-Brookfield RVT - c/P @ 9.6 $sec^{-1}$)

| | | |
|---|---|---|
| 1. 5% Acetic acid | 2.98 pH | 1050 cP |
| 2. 5% $NH_4OH$ | 10.83 pH | 1370 cP |

5. SALT & DYE COMPATIBILITY

A. Salt

| | | | |
|---|---|---|---|
| 1. $CaCl_2$ Saturated) | Compatible | 5. 1% $CaCl_2$ $2H_2O$ | Compatible |
| 2. Amm. polyphosphate | Precipitate | 6. 1% KCl | Compatible |
| 3. 60% $NH_4NO_3$ | Compatible | 7. 0.1% KCl | 1570 cP* |
| 4. 1% $Al_2(SO_4)_3 \cdot 18H_2O$ | Compatible | 8. 2.5% KCl | 1580 cP |

*(Wells-Brookfield RVT - c/P @ 9.6 $sec^{-1}$)

B. Dyes

| | | | |
|---|---|---|---|
| 1. Milling Green | Compatible | 2. Methylene Blue | Precipitate |

6. TEXTURE/FLOW PROPERTIES

High viscosity gum, smooth continuous flow, elastic, no gelation, slightly gummy to the touch.

7. SYNERGISM & ENZYMES
Wells-Brookfield RVT - c/P at 9.6 $sec^{-1}$)

| | 1% n | 0 hour n of mixture | 2 hour n of mixture | Expected viscosity | Synergism |
|---|---|---|---|---|---|
| A. Guar | 1290 cP | 850 cP | 1340 cP | 1250 cP | +7% |
| B. H. P. Guar | 1820 cP | 1410 cP | 1430 cP | 1500 cP | None % |
| C. CMC | 790 cP | 450 cP | 490 cP | 980 cP | None % |
| D. HEC | 590 cP | 870 cP | 910 cP | 850 cP | +7% |
| E. S-119 | 1230 cP | | | | |

8. MILK REACTIVITY

A. Dispersion: Excellent
B. Whey off: 1st day

9. FILM FORMULATION

Film formed, slightly plastic, high tensile strength.

The invention is further defined by reference to the following examples, which are intended to be illustrative and not limiting.

EXAMPLE 1

Pilot Plant Production of Heteropolysaccharide S-119

Seed preparation is started in YM broth incubated at 30° C. The YM seeds are used at 24 hours to inoculate 100 gal. of seed medium which is composed of:

3.0% Glucose
0.5% $K_2HPO_4$
0.05% Promosoy 100
0.09% $NH_4NO_3$
0.01% $MgSO_4.7H_2O$
0.13% Defoamer FCA-200*
+1 ppm $Fe^{++}$
+1 ppm $Mn^{++}$

*Union Carbide

At 29 hours, 100 gal. of this medium is used to inoculate the final fermentor.

| | | |
|---|---|---|
| Inoculum: (100 gals) | Age - 29 hrs | |
| | pH - NA | |
| | Viscosity - 700 cP | |
| Medium: (1100 gals) | Glucose | 5.0% |
| | $NH_4NO_3$ | 0.15% |
| | $K_2HPO_4$ | 0.05% |
| | Promosoy 100 | 0.20% |
| | $MgSO_4 . 7H_2O$ | 0.05% |
| | FCA-200 | 0.08% |
| | KOH | To control pH at 6.5–7.2. |

Fermentation:
Time - 63 hrs
Beer pH - 7.6
Temperature - 30° C.
Aeration - 0 hrs: 40 CFM;
15 hrs: 80 CFM;
35 hrs: 100 CFM;
Viscosity - 1680 cP
Agitation: Disc and turbine impellors
Number of sets: 3
Number of blades/set: 5
Disc diameter: 20 inches
Blade dimension: 2½" × 4"
Impellor diameter: 28"
Speed 150 rpm
Recovery: Beer pH adjust to 6.9 with $H_2SO_4$
Beer rate - 5 gpm
Pasteurization - 165° F./6–7 min.
Ppt. with 60% spent IPA
Dried at 150° F., for ≈30 min., max.
Milled through 40 mesh
Yield: 2.08%

EXAMPLE 2

Evaluation of S-119 as a Warp Size (Aqueous Blending) with PVOH

A size is prepared by mixing 100 g S-119 in 900 g $H_2O$ at 22° C. with agitation until a smooth solution is obtained. This solution is either tested by itself or is blended with polyvinyl alcohol (Evanol® T-25, DuPont Polymer Products Div., Wilmington, Del.) by heating to at least 71° C. with agitation until the PVOH dissolves. A plasticizer (Glycerine, Purified, Atlas Chem. Co., San Diego, Calif.) is optionally added to both the S-119 size and the S-119/PVOH size. (The amounts of plasticizer are shown as % plasticizer based on weight solids).

The various sizes are drawn down at a thickness of 0.02" (0.002" dry) on a smooth polyester surface (Mylar, E. Kodak Co.) and allowed to dry. The dried and cut films are very flexible. The films are conditioned at 28° C. 60% relative hymidity for 48 hours. They are put through testing on an Instron, Model 1122 (Instron Corp., Canton, Mass.), which measures the tensile strength and elongation at the moment of breaking the film. The data of Table 4 are obtained.

The data demonstrate the high tensile strength size obtainable from S-119 and also that although % elongation of S-119 by itself is not greatly improved by a plasticizer such as glycerin, the % elongation of S-119 blends can be beneficially affected by a plasticizer without reducing the tensile strength.

TABLE 4

S-119 EVALUATION

| Sample | % Elongation | Tensile Strength (psi) |
|---|---|---|
| S-119 | 1.2 | 7223 |
| S-119 & 10% Gly | 1.2 | 4231 |
| S-119 & 20% Gly | 3.1 | 2167 |
| 10:90 S-119:PVOH | 54.4 | 4127 |
| 10:90 S-119:PVOH & 10% Gly | 133.0 | 4437 |
| 20:80 S-119:PVOH | 86.1 | 4643 |
| 20:80 S-119:PVOH & 10% Gly | 149.5 | 5673 |
| 90:10 S-119:PVOH | 6.3 | 2579 |
| 90:10 S-119:PVOH & 10% Gly | 6.3 | 3095 |

EXAMPLE 3

Evaluation of S-119 as a Warp Size (Non-aqueous Blending) with PVOH

A size is prepared by first mixing S-119 with polyvinyl alcohol, Evanol® T-25, in the following wt/wt ratios:

| S-119:PVOH |
|---|
| 0:100 |
| 5:95 |
| 10:90 |
| 15:85 |
| 20:80 |
| 100:00 |

Ten (10) grams of each of these blends are added to 90 g of $H_2O$ and heated with agitation to 100° C. They are cooled to room temperature and drawn on Mylar to form films approximately 0.02" thick. These films are allowed to dry, cut into strips, and aged at 50% relative humidity, 21° C. for 72 hours. After aging, the films' thicknesses are measured and they are tested on an Instron model 1122. The results (Table 5) show that S-119 does not adversely affect tensile strength, even at this low RH.

TABLE 5

| Blend (S-119:PVOH) | Tensile strength (psi) |
|---|---|
| 0:100 | 4,666 |
| 5:95 | 10,000 |
| 10:90 | 10,000 |
| 15:85 | 8,000 |
| 20:80 | 7,833 |
| 100:00 | 2,166 |

EXAMPLE 4

Effect of S-119 on Washout of PVOH

Samples of PVOH and S-119:PVOH sizes are prepared as in Example 2. The samples are evaluated for % elongation and tensile strength as described. The data of Table 6 are obtained.

TABLE 6

EFFECT OF S-119 ON ELONGATION & TENSILE STRENGTH OF PVOH

| S-119:PVOH | T.S. (psi) | % Elongation |
|---|---|---|
| 0:100 | 3600 | 127 |
| 2:98 | 3600 | 121 |
| 5:95 | 3600 | 121 |
| 8:92 | 3600 | 121 |
| 10:90 | 3600 | 121.5* |
| 12:88 | 3920 | 124.4 |
| 15:65 | 3920 | 127 |

*Comparing these results to those of the 10:90 blend in Table 4 demonstrates that relative humidity has an effect on tensile strength and % elongation. The data of Table 6 were obtained at a higher relative humidity than those of Table 4; thus, % elongation is greater and tensile strength is lower under more humid conditions.

The 10:90 blend and the PVOH are the treated by placing a strip (approx. 2.5 cm by 15 cm) 2 mil thick in a pellet disintegration tester, with water at room temperature (approx. 22° C.). This tester consists of a chamber where a sample can be placed and which moves up and down in the water to create mild agitation. The holding chamber has approx. 10 mesh screens on the bottom to allow water in and out. After 1 hr. and 19 min., the 10:90 blend had disintegrated and none was left in the test chamber. 100% PVOH did not disintegrate even after 8 hours of treatment.

What is claimed is:

1. A warp size which comprises an aqueous solution of 2% to 15% (wt/wt) of a warp sizing agent which is Heteropolysaccharide S-119.

2. A warp size of claim 1 which comprises 4% to 9% of Heteropolysaccharide S-119.

3. A warp size of claim 1 further comprising a second sizing agent wherein the wt:wt ratio (S-119:second sizing agent) ranges from 90:10 to 2:98.

4. A warp size of claim 3 wherein the second sizing agent is starch, polyvinyl alcohol, or carboxymethyl cellulose.

5. A warp size of claim 1 or 3 further comprising 2% to 25% (based on weight sizing agents) of a plasticizer.

6. A warp size of claim 5 which comprises 4% to 9% S-119 and PVOH in the wt:wt ratio S-119:PVOH 40:60 to 2:98.

7. A warp size of claim 6 which comprises 10:90 to 20:80 S-119:PVOH and 10% glycerin.

8. A process for sizing warp which comprises coating thread with a Heteropolysaccharide S-119 solution.

9. A process of claim 8 which comprises coating thread with a 2 to 15% (wt/wt) solution which comprises: (1) a sizing agent which is Heteropolysaccharide S-119, and (2) a second sizing agent wherein said agent is starch, polyvinyl alcohol, or CMC and wherein the ratio Heteropolysaccharide is S-119:second sizing agent ranges from 90:10 to 2:98.

10. A process of claim 9 wherein the solution further comprises 2% to 25% (based on weight sizing agents) plasticizer.

* * * * *